US006238062B1

(12) United States Patent
Hsu

(10) Patent No.: US 6,238,062 B1
(45) Date of Patent: May 29, 2001

(54) MODIFIED LAMP SERIES

(76) Inventor: Min-Hsun Hsu, No. 3, Lane 49, Hsao-Nien St., Hsin-Chu City (TW)

( * ) Notice: Subject to any disclaimer, the term of this patent is extended or adjusted under 35 U.S.C. 154(b) by 0 days.

(21) Appl. No.: 09/453,436

(22) Filed: Dec. 3, 1999

(51) Int. Cl.[7] ..... F21V 29/00

(52) U.S. Cl. ..... 362/267; 362/226; 362/391; 362/377; 362/378; 362/806; 439/611; 439/617; 439/699.1; 439/699.2; 439/602; 439/666

(58) Field of Search ..... 362/226, 267, 362/806, 391, 377, 378; 439/611, 617, 699.1, 699.2, 602, 666, 667, 619

(56) References Cited

U.S. PATENT DOCUMENTS 5,626,415 * 5/1997 Huang ..... 362/226
5,667,296 * 9/1997 Cheng ..... 362/267
5,738,435 * 4/1998 Lin et al. ..... 362/249

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

The present invention proposes a modified lamp series. The lamp series is a power cable with a plurality of bulb sets installed thereon. Each bulb set comprises a bulb seat, a fixing outer lid, and a bearing soft core. An accommodation groove is disposed in the bulb seal. An outer thread is formed on the upper periphery of the bulb seat. An inner thread is formed in the fixing outer lid. A retaining ring is installed on the top of the fixing outer lid. A bulb base of the light bulb penetrates an opening at the center of the retaining ring. The inner thread of the fixing outer lid can be matched exactly with the outer thread of the bulb seat such that the fixing outer lid can be screwed firmly on the bulb seat. The bearing soft core can be lapped exactly in the accommodation groove. Two opposite holes are disposed at proper positions of the bottom of the bearing soft core. The bulb base of the light bulb penetrates the opening of the fixing outer lib and is placed in the bearing soft core. Two conducting threads at the tail of the bulb base is threaded through the two opposite holes and is bent at two sides of the bearing soft core. The fixing outer lid is then screwed tightly on the bulb seat such that the bearing soft core and the light bulb can be fixed firmly in the bulb seat.

3 Claims, 4 Drawing Sheets

MODIFIED LAMP SERIES

FIELD OF THE INVENTION

The present invention relates to a modified lamp series and, more particularly, to a modified connector and a modified seat of light bulb of a lamp series.

BACKGROUND OF THE INVENTION

Because a lamp series, such as a Christmas lamp series, has a good decorating effect, it is well adored by the people. The lamp series is an electric article such that its structure, safety, and performance need to be taken into account. Two kinds of lamp series in prior art shown in FIGS. 1 and 2 have their drawbacks. As shown in FIG. 1, a lamp series is a power cable with a plurality of bulb sets installed thereon. Each bulb set comprises a light bulb 10, a soft core 12, and a soft head 14. After the light bulb 10 is inserted in the soft core 12, conducting threads 16 are respectively bent upwards at two sides of the soft core 12. The soft core 12 is then lapped in the soft head 14 such that the soft core 12 is electrically connected to conducting plates 18 in the soft head 14. But the soft core 12 of the lamp series must be lapped exactly in the soft head 14. If the soft head 14 is too large, the conducting threads 16 will not contact well with the conducting plates 18 such that the conduction is not good and the soft core 12 and the light bulb 10 thereon will easily become loose so as to shed. If the soft head 14 is too small, it is difficult to lap the soft core 12 in the soft head 14. The assembly will be difficult and cumbersome.

As shown in FIG. 2, another lamp series in prior art is a power cable with a plurality of copper caps 20 installed thereon. An inner thread is formed in the copper cap 20. A copper head 26 having an outer thread is formed at the bottom of a light bulb 24 such that the copper head 26 of the light bulb 24 can be screwed in the copper cap 20 to achieve electric connection. Although assembly of this kind of lamp series is convenient, the metallic material of the copper head and the copper cap makes its cost high. Moreover, metallic material has no waterproof effect.

SUMMARY OF THE INNIENTION

The primary object of the present invention is to provide a waterproof lamp series that has characteristics of simple assembly and low cost.

Another object of the present invention is to increase the stability of assembly and connection between components and to reduce the problem of inexact assembly such that components will not shed.

According to the present invention, a lamp series is a power cable connecting a plurality of bulb sets. Each bulb set comprises a bulb seat, a fixing outer lid, and a bearing soft core. An accommodation groove is disposed in the bulb seat. An outer thread is formed on the upper periphery of the bulb seat. An inner thread is formed in the fixing outer lid. A retaining ring is installed on the top of the fixing outer lid. A bulb base of the light bulb penetrates an opening at the center of the retaining ring. The inner thread of the fixing outer lid can be matched exactly with the outer thread of the bulb seat such that the fixing outer lid can be screwed firmly on the bulb seat. The bearing soft core can be lapped exactly in the accommodation groove. Two opposite holes are disposed at proper positions of the bottom of the bearing soft core. The bulb base of the light bulb penetrates the opening of the fixing outer lid and is placed in the bearing soft core. Two conducting threads at the tail of the bulb base is threaded through the two opposite holes and is bent at two sides of the bearing soft core. The fixing outer lid is then screwed tightly on the bulb seat such that the bearing soft core and the light bulb can be fixed firmly in the bulb seat.

This and other objects, features and advantages of the present invention will become apparent to those skilled in the art upon consideration of the following description of the preferred embodiments of the present invention taken in conjunction with the accompanying drawings.

DETAILED DESCRIPTION OF THE PREFERRED EMBODIMENTS

Figure 1:
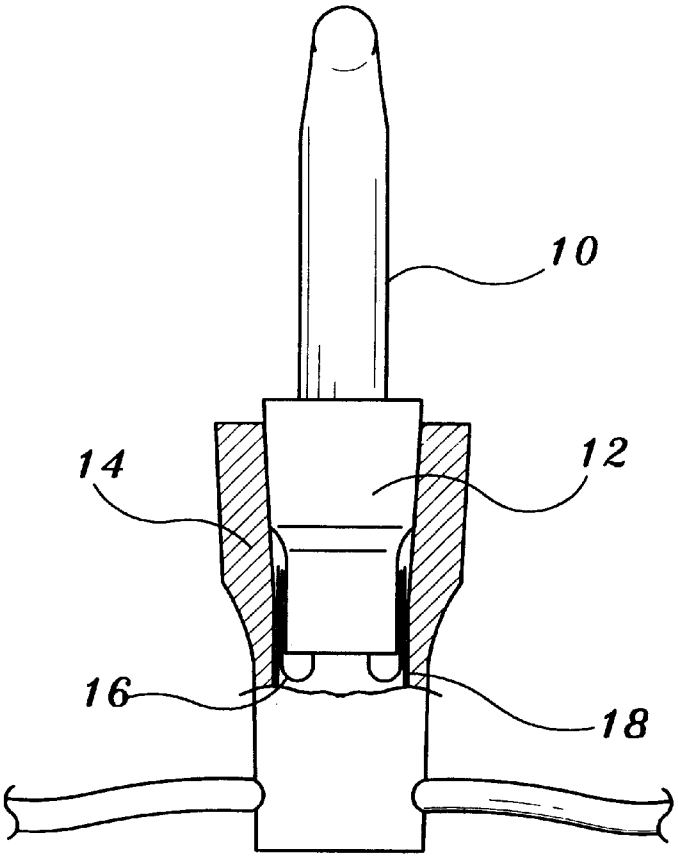
Fig. 1 (PRIOR ART)
FIG. 1 is a diagram of a lamp series in prior art.
Figure 2:
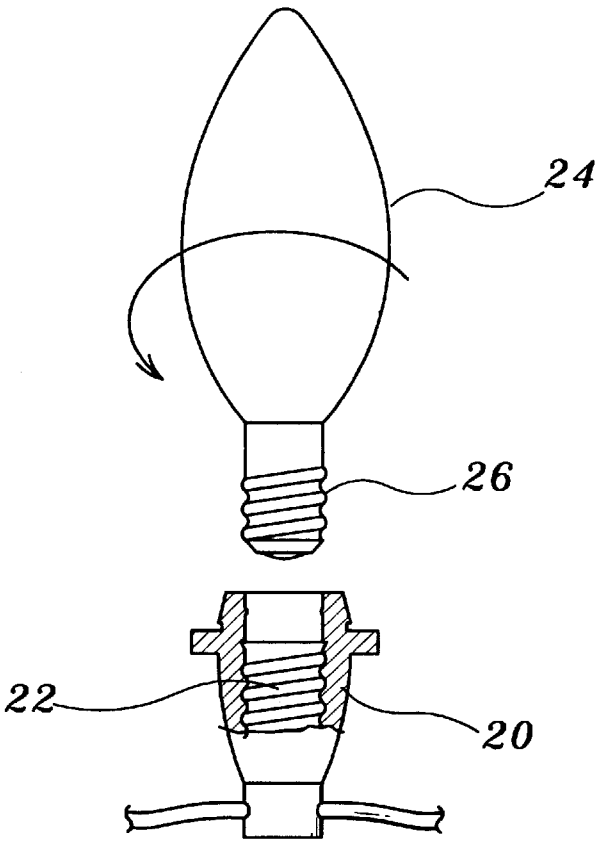
Fig.2 (PRIOR ART)
FIG. 2 is a diagram of another lamp series in prior art.
Figure 3:
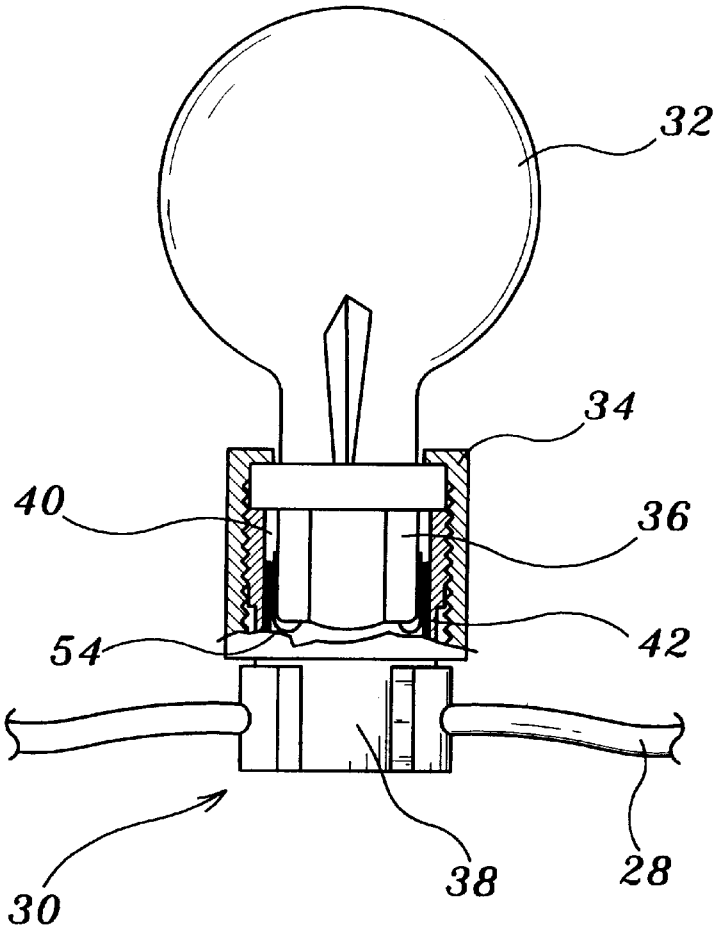
FIG. 3 is a cross-sectional view of a lamp series according to the present invention.
Figure 4:
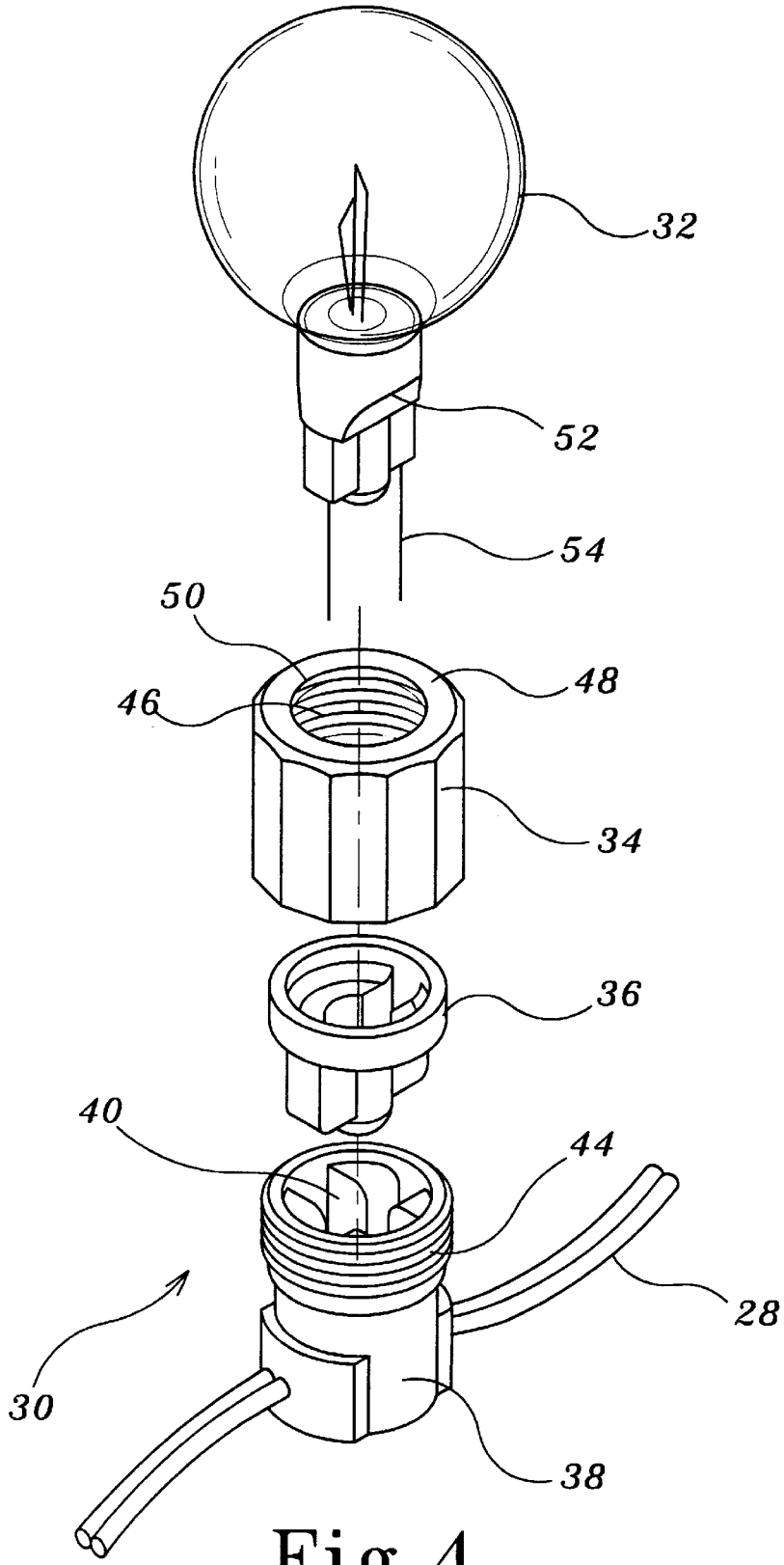
FIG. 4 is an exploded view of a lamp series according to the present invention.

As shown in FIGS. 3 and 4, a lamp series is a power cable 28 with a plurality of bulb sets 30 installed thereon. Each bulb set 30 comprises a light bulb 32, a fixing outer lid 34, a bearing soft core 36, and a bulb seat 38 such that the light bulb 32 in the bulb set 30 can successfully glow.

In the bulb set 30, a bulb seat 38 is connected to the power cable 28. An accommodation groove 40 is disposed in the bulb seat 38. Two opposite conducting plates 42 electrically connected to the power cable 28 are installed in the accommodation groove 40. An outer thread 44 is formed on the upper periphery of the bulb seat 38. An inner thread is formed on the inner periphery of the fixing outer lid 34. A retaining ring 48 is installed on the top of the fixing outer lid 34. A bulb base 52 of the light bulb 32 penetrates an opening 50 at the center of the retaining ring 48. The inner thread 46 of the fixing outer lid 34 can be matched exactly with the outer thread 44 of the bulb seat 38 such that the fixing outer lid 34 can be screwed firmly on the bulb seat 38. The bearing soft core 36 is matched to that of the accommodation groove 40 of the bulb seat 38 such that the bearing soft core 36 can be lapped exactly in the accommodation groove 40. The space in the bearing soft core 36 is also matched to the bulb base 52 of the light bulb 32. Two opposite holes (not shown) are disposed at proper positions of the bottom of the bearing soft core 36 such that the bulb base 52 is lapped exactly in the bearing soft core 36. Two conducting threads 54 at the tail of the bulb base 52 are respectively threaded through the two opposite holes.

When the bulb base 52 of the light bulb 32 penetrates the opening 50 of the fixing outer lib 34 and is lapped in the bearing soft core 36, and the two conducting threads 54 at the tail of the bulb base 52 are respectively threaded through the two opposite holes and bent at two sides of the bearing soft core 36, the retaining ring 48 of the fixing outer lid 34 will stick tightly to the top of the bearing soft core 36 and cover the whole bearing soft core 36. The inner thread 46 of the fixing outer lid 34 is then screwed on the outer thread 44 of the bulb seat 38 and then screwed tightly on the bulb seat 38 such that the bearing soft core 36 and the bulb base 52 of the light bulb 32 can be fixed firmly in the bulb seat 38. The bearing soft core 36 can be lapped exactly in the accommodation groove 40 in the bulb seat 38 so as to form a properly tight assembly. The conducting threads 54 at two sides of the bearing soft core 36 will respectively contact tightly to the conducting copper plates 42 in the accommodation groove 40 to achieve electric connection.

The bulb seat, the fixing outer lid, and the bearing soft core mentioned above are all integrally formed by mold injection. The manufacture is simple and convenient. Because they are made of plastic material, their costs are lower. The bearing soft core is made of a heatproof soft material such as silicone so as to bear high temperature resulted from the glow of the light bulb, to provide a resilient buffer when the fixing outer lid is screwed firmly on the bulb seat, and to contact tightly with the fixing outer lid.

Because the bulb seat, the fixing outer lid, and the bearing soft core of the present invention are all made of non-conducting material and they are joined tightly, waterproof effect is thus very good. Assembly process is simple and convenient, and the cost is low. Moreover, because the structure of the lamp series of the present invention can increase the stability of assembly and connection between components and reduce the problem of inexact assembly, it is not necessary to worry about that the components and the light bulb will shed.

While the present invention has been described in conjunction with preferred embodiments thereof, it is evident that many alternatives, modifications, and variations will be apparent to those skilled in the art. Accordingly, it is intended to embrace all such alternatives, modifications, and variations that fall within the spirit and scope thereof as set forth in the appended claims.

I claim:

1. A modified lamp series being a power cable with a plurality of bulb sets installed thereon such that a light bulb in each said bulb set can glow, each said bulb set comprising:

a bulb seat connected to said power cable, an accommodation groove being disposed in said bulb seat, an outer thread being formed on the upper periphery of said bulb seat;

a fixing outer lid with an inner thread being formed therein, a retaining ring being installed on the top of said fixing outer lid, a bulb base of said light bulb penetrating an opening at the center of said retaining ring, said inner thread of said fixing outer lid being matched exactly with said outer thread of said bulb seat; and a bearing soft core matched to said accommodation groove of said bulb seat, two opposite holes being disposed at proper positions of the bottom of said bearing soft core, said bulb base of said light bulb penetrating said opening of said fixing outer lid and being placed in said bearing soft core, two conducting threads at the tail of said bulb base being threaded through said two opposite holes and bent at two sides of said bearing soft core, said retaining ring of said fixing outer lid sticking tightly to the top of said bearing soft core, said fixing outer lid being screwed tightly on said bulb seat, whereby said bearing soft core and said light bulb can be fixed firmly in said bulb seat.

2. The modified lamp series of claim 1, wherein said bulb seat, said fixing outer lid, and said bearing soft core are all integrally formed by mold injection.

3. The modified lamp series of claim 1, wherein said bearing soft core is made of heatproof soft material.

* * * * *